US010273098B2

(12) United States Patent
Kim

(10) Patent No.: US 10,273,098 B2
(45) Date of Patent: Apr. 30, 2019

(54) CASSETTE PUSH PLATE LOCKING DEVICE

(71) Applicant: ATEC AP CO., LTD., Seongnam-si, Gyeonggi-do (KR)

(72) Inventor: Do Wan Kim, Seoul (KR)

(73) Assignee: ATEC AP CO., LTD, Gyeonggi-Do (KR)

( * ) Notice: Subject to any disclaimer, the term of this patent is extended or adjusted under 35 U.S.C. 154(b) by 0 days.

(21) Appl. No.: 15/782,444

(22) Filed: Oct. 12, 2017

(65) Prior Publication Data

US 2018/0105347 A1 Apr. 19, 2018

(30) Foreign Application Priority Data

Oct. 17, 2016 (KR) ..... 10-2016-0134212

(51) Int. Cl.
*B65H 1/12* (2006.01)
*B65H 1/14* (2006.01)
*G07D 11/00* (2006.01)

(52) U.S. Cl.
CPC ..... *B65H 1/12* (2013.01); *B65H 1/14* (2013.01); *G07D 11/0006* (2013.01); *G07D 11/0009* (2013.01); *B65H 2405/11* (2013.01); *B65H 2405/31* (2013.01); *B65H 2701/1912* (2013.01)

(58) Field of Classification Search
CPC ..... B65H 1/12; B65H 1/14; B65H 2403/47; B65H 2403/732; B65H 2403/5151
See application file for complete search history.

(56) References Cited

U.S. PATENT DOCUMENTS 6,354,586 B1 * 3/2002 Samoto ..... B65H 1/14 271/127
7,722,032 B2 * 5/2010 Sasaki ..... B65H 1/14 271/157
9,233,807 B2 * 1/2016 Lo ..... B65H 1/14
2004/0251600 A1 * 12/2004 Amamoto ..... B65H 1/12 271/152
2005/0286947 A1 * 12/2005 Kitamura ..... B65H 1/12 399/393
2007/0176349 A1 8/2007 Gerlier et al.
2011/0062653 A1 * 3/2011 Hasegawa ..... B65H 1/14 271/126
2011/0062656 A1 * 3/2011 Shimosato ..... B65H 1/14 271/157
2012/0187620 A1 * 7/2012 Kitamura ..... B65H 1/14 271/10.01
2014/0353906 A1 * 12/2014 Toya ..... B65H 1/14 271/146

(Continued)

FOREIGN PATENT DOCUMENTS

JP 2008-009709 A 1/2008
JP 2013-200789 A 10/2013

(Continued)

*Primary Examiner* — Patrick Cicchino
(74) *Attorney, Agent, or Firm* — Dentons US LLP

(57) ABSTRACT

A cassette push plate locking device capable of absorbing impact to the cassette push plate according to the present disclosure, includes a cassette push plate disposed in a cassette, a locking lever that is movable by switching of a cassette door; and a locking unit including a torque limiter that allows the cassette push plate to move over a predetermined force and prevents the cassette push plate from moving under the predetermined force.

8 Claims, 8 Drawing Sheets

(56) References Cited

U.S. PATENT DOCUMENTS

2016/0297631 A1* 10/2016 Okazaki ..... B65H 1/14

FOREIGN PATENT DOCUMENTS

| | | | |
|---|---|---|---|
| KR | 101046821 | B1 | 7/2011 |
| KR | 10-2011-0132543 | A | 12/2011 |
| KR | 1020110132690 | A | 12/2011 |
| WO | 2010026632 | A1 | 3/2010 |
| WO | 2011150961 | A1 | 12/2011 |

* cited by examiner

CASSETTE PUSH PLATE LOCKING DEVICE

CROSS-REFERENCE TO RELATED APPLICATIONS

This application claims the priority of Korean Patent Application No. 10-2016-0134212 filed on Oct. 17, 2016, in the Korean Intellectual Property Office, the disclosure of which is incorporated herein by reference.

BACKGROUND OF THE INVENTION

Field of the Invention

The present disclosure relates to a cassette push plate locking device.

Description of the Related Art

Cassettes are compartments for receiving cash where final deposits and withdrawals are made in the financial apparatuses, and in some cases, cash transfer is performed while media are received. In this case, a user presses a cassette push plate to eliminate empty space after inserting the media, in order to prevent bills from being misaligned during the media transfer. In addition, the cassette push plate is in a locked state in which the cassette push plate is fixed without moving downwardly due to an external force (self-weight, impact), and thus the media may be transferred without being misaligned in a pressed state.

However, when the cassette push plate is in the locked state, if a high impact is vertically applied to the cassette push plate, the impact is directly transferred to several components relating to a locking device, so that weak portions may be damaged due to this impact. For example, it may actually happen that a bracket relating to a push plate locking unit may be deflected, or gear teeth of a push plate driving unit may be broken.

Therefore, there is a growing need for a cassette push plate locking device capable of absorbing an impact to the cassette push plate.

SUMMARY OF THE INVENTION

An aspect of the present disclosure provides a cassette push plate locking device capable of absorbing an impact to the cassette push plate.

According to an aspect of the present disclosure, there is provided a cassette push plate locking device capable of absorbing an impact to the cassette push plate. The cassette push plate includes: a cassette push plate disposed in a cassette; a locking lever that is movable by switching of a cassette door; and a locking unit including a torque limiter that allows the cassette push plate to move over a predetermined force and prevents the cassette push plate from moving under the predetermined force.

In addition, the cassette push plate may further include: a bracket including a protruding part inserted into a locking lever groove of the locking lever and having one end coupled to the locking unit; and a locking bracket selectively coupled to and released from the locking unit that moves by the movement of the locking lever.

In addition, the cassette push plate may further include an interlocking unit that is coupled to the other end of the bracket and interlocked with rotation of the locking unit, and simultaneously, interlocked with rotation of a push plate driving unit that drives the cassette push plate.

In one example of the cassette push plate locking device according to the present disclosure, the locking unit may further include: a locking part engaged with the locking bracket; and a locking pulley interlocked with the interlocking unit through a belt, and the torque limiter is disposed between the locking part and the locking pulley to couple the locking part to the locking pulley under the predetermined force and decouple the locking part from the locking pulley over the predetermined force.

In addition, the locking part may include a plurality of locking part protrusions that protrude while being inclined in a predetermined direction with respect to a radial direction thereof.

In one example according to the present disclosure, the cassette push plate locking device may include a spring that is attached to the cassette push plate to push or pull the cassette push plate upwardly.

In addition, a gear ratio between the interlocking unit and the push plate driving unit may be determined based on a weight of media to be stacked on the cassette push plate and a restoring force of the spring.

In one example according to the present disclosure, the cassette push plate locking device may further include a first tensile spring that is attached to the locking lever to pull the locking lever toward the cassette door.

In one example according to the present disclosure, the cassette push plate locking device may further include a second tensile spring that is attached to the bracket to pull the bracket toward the cassette door.

In one example according to the present disclosure, the cassette push plate locking device may further include a lock releasing pin that pushes the locking bracket to release the coupling between the locking bracket and the locking unit.

According to another aspect of the present disclosure, there is provided a financial apparatus. The financial apparatus includes a cassette, wherein the cassette includes a cassette push plate locking device that absorbs an impact to a cassette push plate, and the cassette push plate locking device includes: a cassette push plate disposed in the cassette; a locking lever that is movable by switching of a cassette door; and a locking unit including a torque limiter that allows the cassette push plate to move over a predetermined force and prevents the cassette push plate from moving under the predetermined force.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
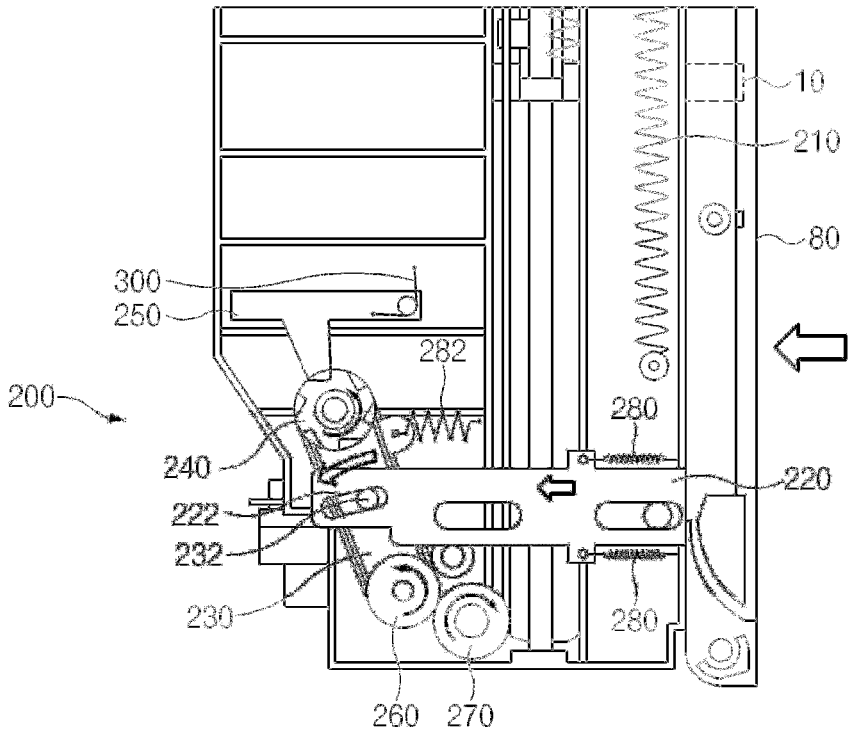
FIG. 1 is a cross-sectional view illustrating a state in which a cassette push plate locking device of the present disclosure is locked.

Hereinafter, various exemplary embodiments of the present disclosure will be described in more detail with reference to the accompanying drawings. It should be noted that the same or similar components in the drawings are designated by the same reference numerals as much as possible, even though they are shown in different drawings. Also, in the following description of embodiments of the present disclosure, a detailed description of known configurations and functions incorporated herein will be omitted when it is determined that the understanding of the embodiments of the present disclosure is hindered by the detailed description.

Also, in the description of the elements according to an embodiment of the present disclosure, the terms of 'first', 'second', 'A', 'B', '(a)', and '(b)' may be used. However, since these terms are used only to distinguish an element from another, the nature, sequence, and order of the elements are not limited thereby. When it is described that an element is "coupled to", "engaged with", or "connected to" another element, it should be understood that the element may be directly coupled or connected to the other element, but still another element may be "coupled to", "engaged with", or "connected to" the other element therebetween them.

Figure 9:
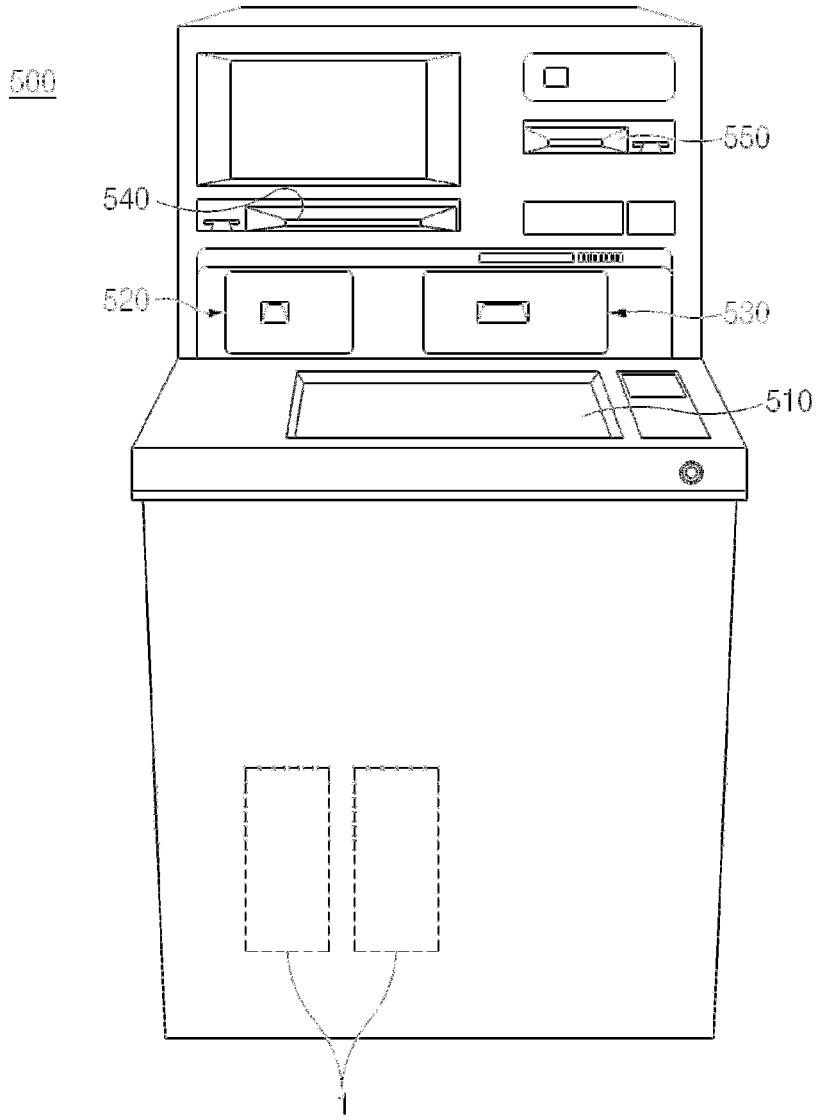
FIG. 9 is a perspective view schematically illustrating a financial apparatus according to the present disclosure.

Referring to FIG. 9, a financial apparatus 500 according to the present disclosure may include a medium processing device for processing a medium.

The financial apparatus 500 may further include a customer information acquiring unit for acquiring information on a customer.

The customer information acquiring unit may include a bankbook processing module 540 through which a bankbook may be inserted and discharged, and the bankbook may be identified. Alternatively, the customer information acquiring unit may include a card processing module 550 through which a card may be inserted and discharged, and the card may be identified.

In the current embodiment, types of the customer information acquiring unit are not limited. For example, the customer information acquiring unit may acquire information recorded in an RFID tag or a USB, or acquire customer information by using bio-information such as fingerprints.

The financial apparatus 500 may further include a user interface 510 which is capable of displaying a menu and information for deposits or withdrawals, or inputting or selecting a command or information for the deposits or withdrawals.

The financial apparatus 500 may further include a control unit (not shown) for controlling the medium processing device, the customer information acquiring unit or the user interface 510 of the financial apparatus, and so on. In this case, the control unit may include a medium processing device control unit for controlling the medium processing device and a financial apparatus control unit for controlling the financial apparatus.

The medium processing device may include an upper module and a lower module. The upper module may be separably connected to the lower module or movably connected to the lower module. Alternatively, the upper module and the lower module may not be connected to each other, but may be maintained in contact with each other.

The medium processing device may include a medium entrance module 520 and 530 for depositing and withdrawing a medium.

The medium entrance module 520 and 530 may have a medium receiving space that is accessible by a customer, and the medium receiving space may be open or closed by a covering member such as a shutter and/or a cover, and in some cases, the medium receiving space may be maintained in an open state without being closed. The medium receiving space may be partitioned into a plurality of receiving spaces by a partition member.

The medium entrance module 520 and 530 may serve as a common depositing and withdrawing part through which various kinds of media such as bills, checks, and gift certificates are insertable or withdrawable. The medium may be fed into the medium entrance module 520 and 530 in a unit of a sheet or bundles. Also, the medium may be discharged from the medium entrance module 520 and 530 in a unit of a sheet or bundles.

Alternatively, an insertion space into which the medium is inserted and a withdrawal space from which the medium is withdrawn may be separately disposed within the medium entrance module 520 and 530. Alternatively, the medium entrance module may a medium inserting module and a medium withdrawing module, which are independent from each other.

The medium processing device may further include a discriminating module (not shown). The discriminating module may identify types, thicknesses, and amounts of medium, or determine a faulty medium, during a medium deposit transaction process and a medium withdrawal transaction process.

The medium processing device may further include a temporary stacking module for temporarily stacking media.

The temporary stacking module may temporarily stack media received through the medium entrance module, when the customer intends to deposit the media into the financial apparatus.

When the customer finally determines the reception of the media, the media stacked in the temporary stacking module may be transferred to a medium storage unit, which will be described below. Alternatively, the temporary stacking module may temporarily stack media that are to be transferred to the medium entrance module.

The medium processing device may further include a medium storage unit for storing a medium. The medium storage unit may include a plurality of cassettes 1.

The plurality of cassettes 1 may include at least one bill storage module and at least one check storage module. In this specification, the numbers of bill storage modules and check storage modules is not limited. For another example, the medium storage unit may include only the bill storage module or only the check storage module. Alternatively, the plurality of cassettes may include a storage module for storing gift certificates, securities, tickets, and so on. Alternatively, the check storage module may be replaced with the storage module for storing gift certificates, securities, tickets, and so on.

The medium processing device may further include a supplementing and collecting module (not shown) for supplementing and collecting the media. The supplementing and collecting module may store at least one of a medium that is to be supplemented to the medium storage unit and a medium that is to be collected from the medium storage unit.

The medium processing device may further include a collecting module (not shown). The collecting module may collect the medium that is determined as the faulty medium in at least one process of a medium deposit transaction process, a medium withdrawal transaction process, a medium supplementing process, and a medium collecting process. That is, the collecting module may receive a medium that is not received by the customer and/or a medium that is determined as a faulty in the discriminating module or a medium that is not identified in the discrimination module, even though the medium is withdrawn through the medium entrance module.

Also, when the financial apparatus has a check deposit/withdrawal function, the medium processing device may further include a deposited check collecting space into which the deposited check transferred from the medium entrance module is collected. In this case, the deposited checks may be divided into checks issued by a bank that operates the above-described financial apparatus and checks issued by another bank, and then collected. The deposited check collecting space may be provided as a module separated from the collecting module, or may be separately stacked in partitioned spaces of the collecting module. The collecting module and/or the check collecting space may be disposed at the most rear side of the financial apparatus so that a teller or a manager opens a door to easily access to the collecting module and/or the check collecting space.

The medium processing device may include a transferring module to transfer, a medium inserted for deposits or a medium discharged for withdrawals, toward respective modules.

Figure 7:
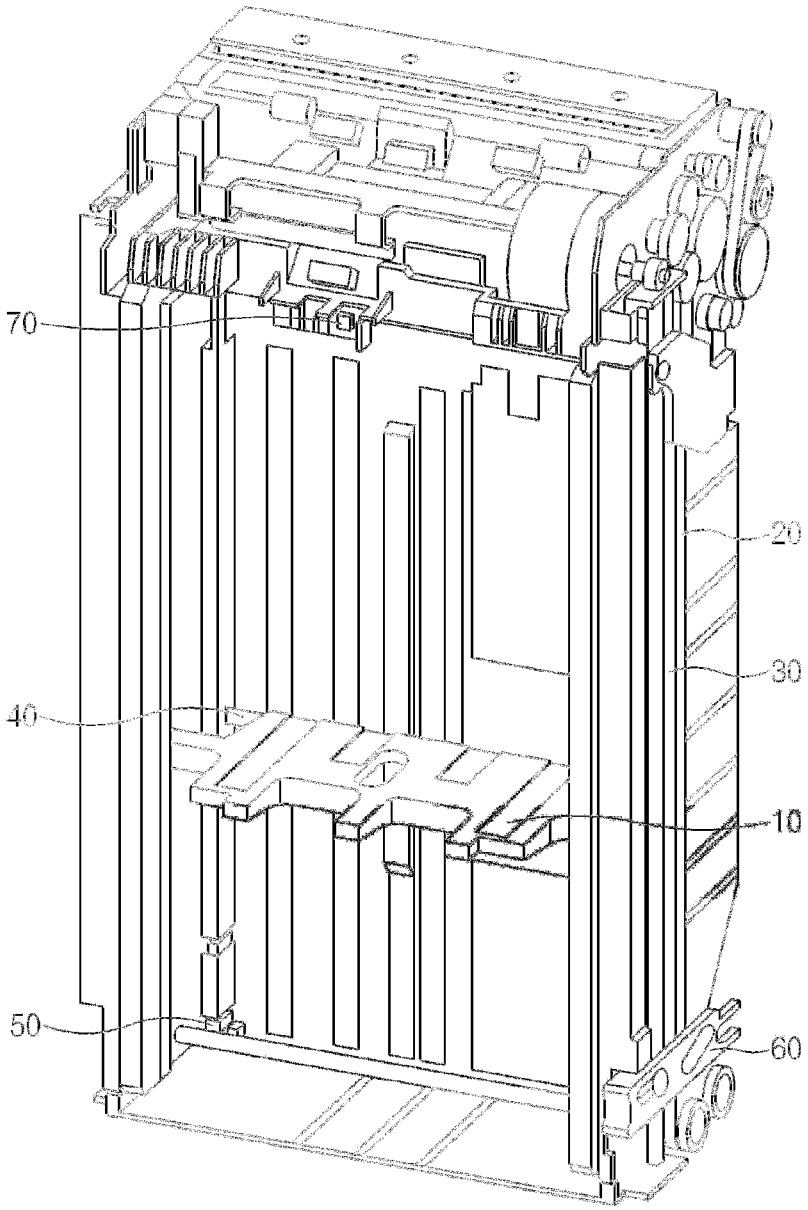
FIG. 7 is a perspective view illustrating a state in which a cassette door of a general cassette is open.
Figure 8:
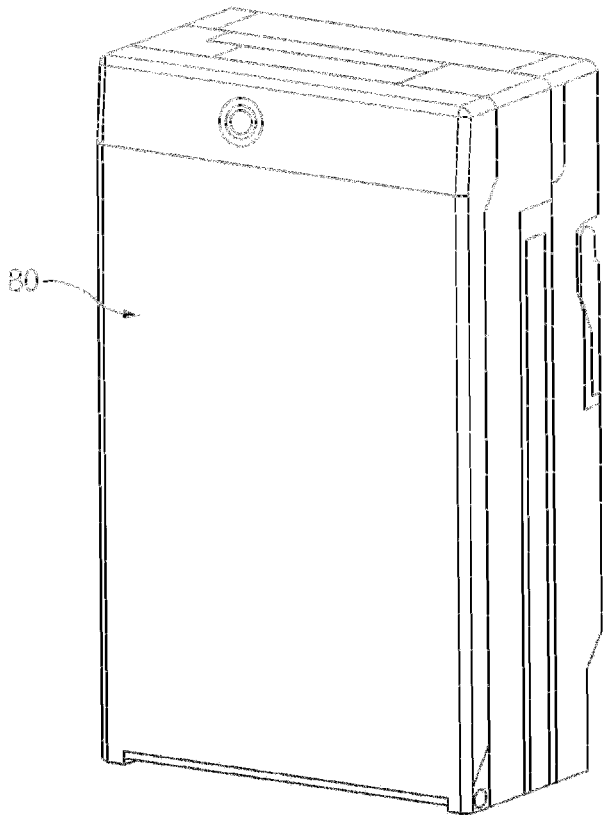
FIG. 8 is a perspective view illustrating a state in which a cassette door of a general cassette is closed.

Examining a configuration of a cassette 1 in reference to FIGS. 7 and 8, the cassette 1 includes a pick-up part 70 disposed in an uppermost position and a stacking part disposed below the pick-up part. The stacking part includes a cassette push plate 10, a push plate conveying belt 20 that transfers a driving force of a step motor (not shown) to move the cassette push plate 10 vertically, a push plate conveying shaft 30, a push plate position detecting bracket 40, a full detection interrupting sensor 50, a push plate locking device 60 for preventing the cassette push plate from being moved by an external force, but not the driving force of the step motor.

Figure 3:
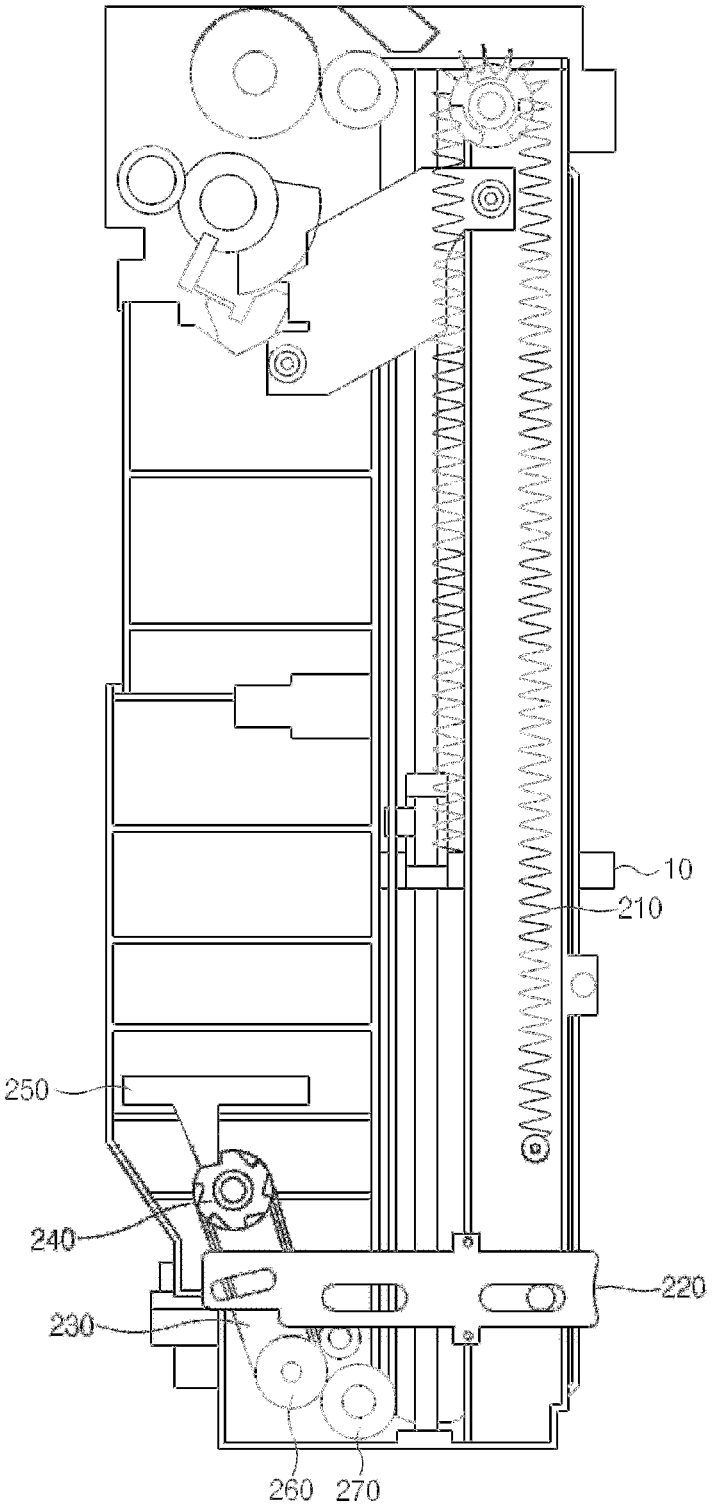
FIG. 3 is an entire cross-sectional view illustrating a state in which a cassette push plate locking device of the present disclosure is locked.

Explaining a cassette push plate locking device 200 according to the present disclosure in reference to FIGS. 1 and 3, the cassette push plate locking device 200 capable of absorbing an impact to the cassette push plate 10, includes the cassette push plate 10 disposed in a cassette 1; a locking lever 220 that is movable by switching of a cassette door 80; and a locking unit 240 including a torque limiter 244 that allows the cassette push plate 10 to move over a predetermined force and prevents the cassette push plate 10 from moving under the predetermined force.

Also, the cassette push plate locking device 200 includes: a bracket 230 including a protruding part 232 inserted into a locking lever groove 222 of the locking lever 220 and having one end coupled to the locking unit 240; a locking bracket 250 that is able to be selectively coupled to and released from the locking unit 240 that moves by the movement of the locking lever 220; and an interlocking unit 260 that is coupled to the other end of the bracket 230 and interlocked with rotation of the locking unit 240, and simultaneously, interlocked with rotation of a push plate driving unit 270 that drives the cassette push plate 10.

When the cassette door 80 moves in a left direction to close the cassette door 80, the locking lever 220 is interlocked with movement of the cassette door 80 to move in the left direction. Then, the locking lever groove 222 of the locking lever 220 pushes the protruding part 232, which is inserted into the locking lever groove 222, of the bracket 230, and thus the bracket 230 rotates in a direction indicated by an arrow to engage the locking unit 240 with the locking bracket 250.

In a state in which the locking unit 240 is engaged with the locking bracket 250, the rotation of the locking unit 240 is restricted in either one of a clockwise direction or a counter clockwise direction, thus the movement of the cassette push plate 10 is restricted in either one of upward and downward directions. For example, since the rotation of the locking unit 240 is prevented in the counter clockwise direction in the drawing, the cassette push plate 10 is in a locked state (a state in which the cassette door 80 is closed), so the cassette push plate 10 is prevented from moving in the downward direction in the drawing.

If the cassette push plate 10 is impacted in the downward direction, the impact is transferred to the push plate driving unit 270 (for example, a push plate driving pulley or a push plate driving gear) and the interlocking unit 260 (for example, an interlocking pulley or an interlocking gear), attempting to rotate the push plate driving unit 270 in the clockwise direction and the interlocking unit 260 in the counter clockwise direction. However, since the locking unit 240 is engaged with the locking bracket 250, the rotation becomes impossible.

The locking unit 240 of the push plate locking device 200 includes: a locking part 246 engaged with the locking unit 250; and a locking pulley 242 interlocked with the interlocking unit 260 through a belt, wherein the torque limiter 244 is disposed between the locking part 246 and the locking pulley to couple the locking part 246 to the locking pulley 242 under the predetermined force and decouple the locking part 246 from the locking pulley 242 over the predetermined force.

In the case of the downward impact to the cassette push plate 10 as described above, the torque limiter 244 maintains the connection between the locking part 246 and the locking pulley 242 under the predetermined force, and thus the locking part 246 rotates with the locking pulley 242. Therefore, although the interlocking unit 260 attempts to rotate the locking pulley 242, the locking pulley 242 may not rotate because the locking part 246 of the locking unit 240 is engaged with the locking bracket 250. Thus, the cassette push plate 10 is prevented from moving downwardly.

However, the torque limiter 244 decouples between the locking part 246 and the locking pulley 242 over the predetermined force, and thus only the locking pulley 242 may rotate in the counter clockwise direction. Thus, the cassette push plate 10 may move downwardly, corresponding to an amount of the impact.

Therefore, since the shock caused by instant impact to the cassette push plate 10 may be absorbed, the cassette push plate 10 is stably maintained in the locked position without damage of components of the cassette push plate locking device 200. That is, the cassette push plate locking device 200 of the present disclosure fixes the cassette push plate 10 against general impact, on the other hand, the cassette push plate locking device 200 moves the cassette push plate 10 downwardly, only when impact of a force enough to damage the components of the cassette push plate locking device 200 is applied, to prevent the components from being damaged while maintaining a function of the cassette push plate locking device 200.

Figure 4:
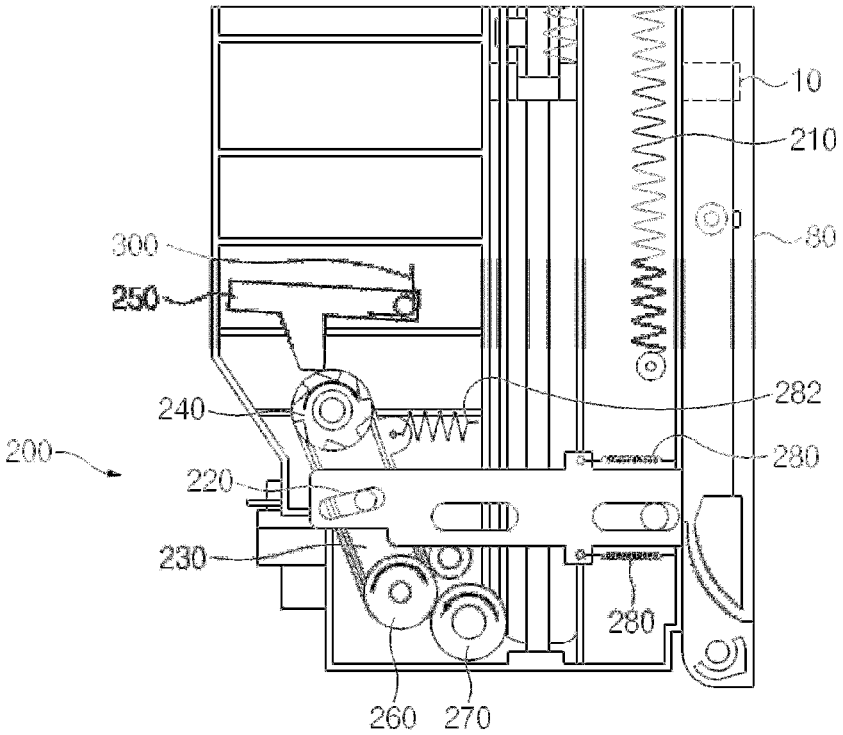
FIG. 4 is a cross-sectional view illustrating a state in which a cassette push plate of an cassette push plate locking device of the present disclosure moves back to its original position.

In one example of the cassette push plate locking device 200 according to the present disclosure, the cassette push plate locking device 200 further includes a spring 210 that is attached to the cassette push plate 10 to push or pull the cassette push plate 10 upwardly. As illustrated in FIG. 4, after the cassette push plate 10 moves downwardly, the cassette push plate 10 may return to its original position by a restoring force of the spring 210.

When the cassette push plate 10 moves upwardly to return to the original position, the push plate driving unit 270 rotates in the counter clockwise direction, and accordingly, the interlocking unit 260 rotates in the clockwise direction. Since the locking bracket 250 prevents the locking unit 240 from rotating in only one direction (for example, the counter clockwise direction in the drawing), the locking pulley 242 may rotate with the interlocking unit 260 in the clockwise direction, and thus the cassette push plate 10 may return to the original position without difficulty.

Figure 2:
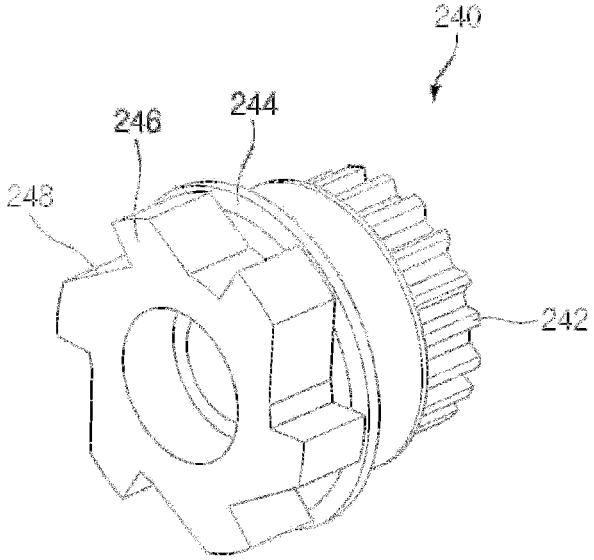
FIG. 2 is a perspective view illustrating a locking unit of a cassette push plate locking device of the present disclosure.

Also, as illustrated in FIG. 2, the locking part 246 may include a plurality of locking part protrusions 248 that protrude while being inclined in a predetermined direction with respect to a radial direction of the locking unit 240.

Figure 5:
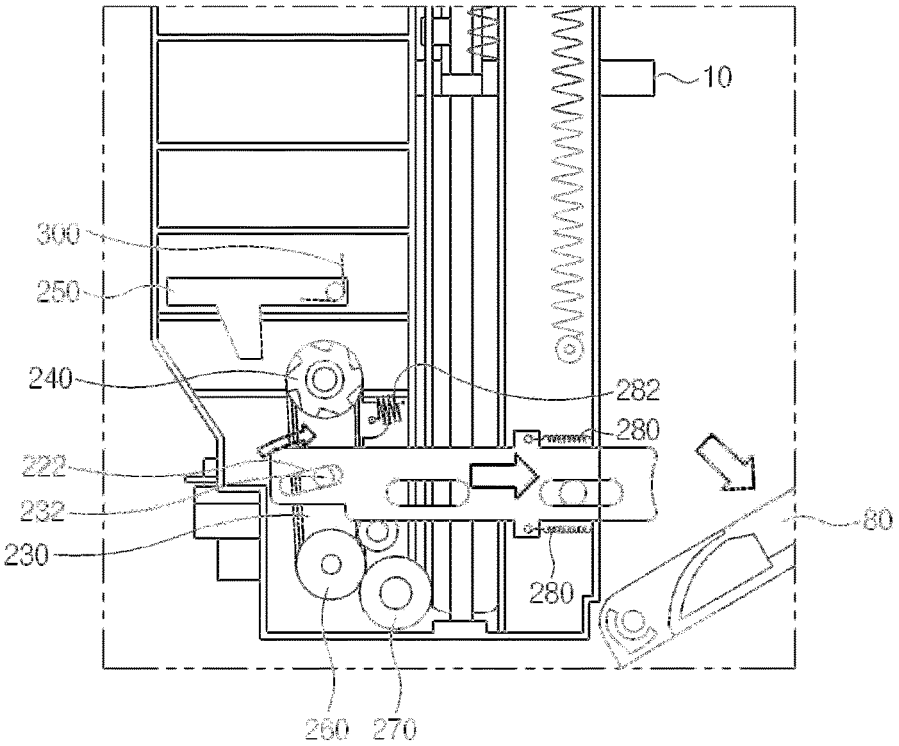
FIG. 5 is a cross-sectional view illustrating a state in which a cassette push plate locking device of the present disclosure is released.

Referring to FIGS. 1 and 5, coupling and releasing operations of the locking unit 240 and the locking bracket 250 of the cassette push plate locking device 200 will be described in more detail.

When the cassette door 80 is closed as illustrated in FIG. 1, because the locking lever groove 222 is engaged with the protruding part 232, the bracket 230 rotates (pivots) in the counter clockwise direction about the interlocking unit 260 according to lateral movement of the locking lever 220, and thus the locking unit 240 is engagingly coupled to the locking bracket 250. Also, when the cassette door 80 is open as illustrated in FIG. 5, the bracket 230 rotates in the clockwise direction about the interlocking unit 260, and thus the locking unit 240 is released from the locking bracket 250. The cassette push plate 10 may be freely operated from the outside, according to the disengagement of the cassette push plate locking device 200. Therefore, the locking unit 240 may be coupled to and released from the locking bracket 250 by using a simple structure that interlocked with the switching of the cassette door 80.

In this case, a gear ratio, between the push plate driving unit 270 and the interlocking unit 260 connected to the push plate driving unit 270, is set based on the weight of media stacked in a stacking space, to thereby prevent the cassette push plate from falling downwardly due to the weight of the media when the door is open. For example, in the case that a spring is connected to the cassette push plate 10, a gear ratio between the interlocking unit 260 and the push plate driving unit 270 is set based on the weight of the media to be stacked on the cassette push plate 10 and the restoring force of the spring, to thereby prevent the misalignment of the media and the damage of the push plate, which are caused by the falling of the cassette push plate when the door is open. Also, the gear ratio may be set so that there is no need for a large amount of force when a user moves the push plate after the door is open.

In one example of the cassette push plate locking device 200 according to the present disclosure, the cassette push plate locking device 200 may further include a first tensile spring 280 that is attached to the locking lever 220 to pull the locking lever 220 in a direction of the cassette door 80. In addition, the cassette push plate locking device 200 may further include a second tensile spring 282 that is attached to the bracket 230 to pull the bracket 230 in the direction of the cassette door 80.

When the cassette door 80 is open, the locking lever 220 is moved to the left by the first tensile spring 280, and accordingly, the protruding part 232 of the bracket 230 is moved to the right by the locking lever groove 222 of the locking lever 220, so that the locking unit 240 is automatically released from the locking bracket 250. Alternatively, when the cassette door 80 is open, the bracket 230 is moved to the right by the second tensile spring 282, so that the locking unit 240 is automatically released from the locking bracket 250. Therefore, the locking unit 240 may be easily released from the locking bracket 250 by the first tensile spring 280 or the second tensile spring 282.

Figure 6:
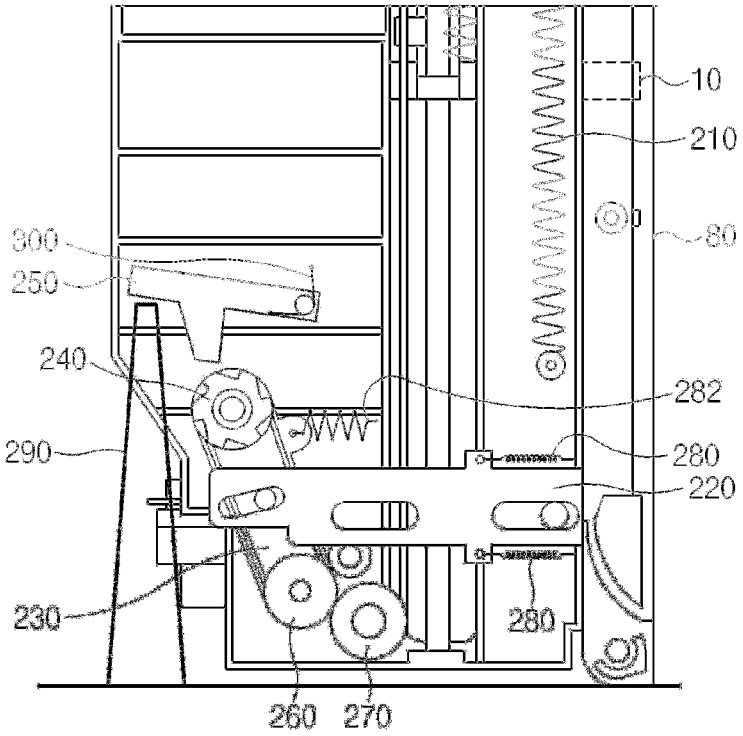
FIG. 6 is a cross-sectional view illustrating a state in which a lock is released by using a locking pin of a cassette push plate torsion correcting device of the present disclosure.

Referring to FIG. 6, in one example of the cassette push plate locking device 200 according to the present disclosure, the cassette push plate locking device 200 further include a lock releasing pin 290 that pushes the locking bracket 250 to release the coupling between the locking bracket 250 and the locking unit 240. When the locking bracket 250 is lifted by the lock releasing pin 290, the locking bracket 250 is released from the locking unit 240, and thus the cassette push plate 10 may freely move in a vertical direction.

Also, the cassette push plate locking device 200 may further include a torsion spring 300 disposed on one end of the locking bracket 250, wherein, when the lock releasing pin 290 is removed, the torsion spring 300 allows the locking bracket 250 to return to its original position so that the locking bracket 250 is re-coupled to the locking unit 240.

Therefore, the effect may be obtained in which the locking bracket 250 is easily released from the locking unit 240, without opening the cassette door 80, only with a simple configuration of the lock releasing pin 290 and the torsion spring 300.

The financial apparatus according to the present disclosure includes the cassette push plate locking device of the present disclosure.

The financial apparatus according to an embodiment of the present disclosure receives various media such as bills, securities, giros, coins, and gift certificates, and then performs financial tasks for processing media, such as processes of making deposits, receiving by giros, and exchanging gift certificates, and/or processes of making withdrawals, discharging giros, and discharging gift certificates. The financial apparatus, for example, may include an automated teller machine (ATM) such as a cash dispenser (CD) and a cash recycling device. However, the financial apparatus is not limited thereto, but may include various apparatuses that automate financial tasks, such as a financial information system (FIS).

According to the present disclosure, since the shock caused by an instant impact vertically applied to the cassette push plate may be absorbed, the cassette push plate is stably maintained in the locking position without damage of components of the cassette push plate locking device.

All components according to an embodiment of the present disclosure may be coupled to one another to form a single body or to operate as a single body, but the present disclosure is not necessarily limited thereto. That is, one or more components are selectively coupled and operated within the scope of the present disclosure. Also, the terms "comprising," "including," and "having," as used in the claims and specification herein, shall be considered as indicating an open group that may include other elements not specified. Unless otherwise defined, all terms (including technical and scientific terms) used herein have the same meaning as generally understood by those skilled in the art to which the present disclosure pertains. Terms such as terms that are generally used and have been in dictionaries should be construed as having meanings matched with contextual meanings in the art. In this description, unless defined clearly, terms are not ideally, excessively construed as formal meanings.

The above-disclosed subject matter is to be considered illustrative, and not restrictive, so it will be understood by those skilled in the art that various changes and modifications may be made therein without departing from the spirit and scope of the present disclosure. Thus, the embodiments of the present disclosure are to be considered illustrative, and not restrictive, and the technical spirit of the present disclosure is not limited to the foregoing embodiments. Therefore, the scope of the present disclosure is defined not by the detailed description of the present disclosure but by the appended claims, and their equivalents should be interpreted to be included in the scope of right in the present disclosure.

What is claimed is:

1. A cassette push plate locking device, comprising:

a cassette push plate disposed in a cassette;

a locking lever that is movable by switching of a cassette door;

a locking unit comprising a torque limiter that allows the cassette push plate to move when a force greater than a predetermined force is applied to the torque limiter by an impact to the cassette push plate and prevents the cassette push plate from moving when the force less than the predetermined force is applied to the torque limiter by the impact to the cassette push plate;

a bracket comprising a protruding part inserted into a locking lever groove of the locking lever and having one end coupled to the locking unit;

a locking bracket selectively coupled to and released from the locking unit that moves by the movement of the locking lever; and an interlocking unit that is coupled to the other end of the bracket and interlocked with rotation of the locking unit, and simultaneously, interlocked with rotation of a push plate driving unit that drives the cassette push plate, wherein the locking unit further comprises a locking part engaged with the locking bracket, a locking pulley interlocked with the interlocking unit through a belt, and the torque limiter is disposed between the locking part and the locking pulley to couple the locking part to the locking pulley when the force less than the predetermined force is applied to the cassette push plate and decouple the locking part from the locking pulley when the force greater than the predetermined force is applied to the cassette push plate.

2. The cassette push plate locking device of claim 1, wherein the locking part comprises a plurality of locking part protrusions that protrude while being inclined in a predetermined direction with respect to a radial direction thereof.

3. The cassette push plate locking device of claim 1, further comprising a spring that is attached to the cassette push plate to push or pull the cassette push plate upwardly.

4. The cassette push plate locking device of claim 3, wherein a gear ratio between the interlocking unit and the push plate driving unit is determined based on a weight of media to be stacked on the cassette push plate and a restoring force of the spring.

5. The cassette push plate locking device of claim 1, further comprising a first tensile spring that is attached to the locking lever to pull the locking lever toward the cassette door.

6. The cassette push plate locking device of claim 1, further comprising a second tensile spring that is attached to the bracket to pull the bracket toward the cassette door.

7. The cassette push plate locking device of claim 1, further comprising a lock releasing pin that pushes the locking bracket to release the coupling between the locking bracket and the locking unit.

8. A financial apparatus comprising a cassette, wherein the cassette comprises a cassette push plate locking device that absorbs an impact to a cassette push plate, and the cassette push plate locking device comprises:

a cassette push plate disposed in the cassette;

a locking lever that is movable by switching of a cassette door; and a locking unit comprising a torque limiter that allows the cassette push plate to move when a force greater than a predetermined force is applied to the torque limiter by an impact to the cassette push plate and prevents the cassette push plate from moving when the force less than the predetermined force is applied to the torque limiter by the impact to the cassette push plate;

a bracket comprising a protruding part inserted into a locking lever groove of the locking lever and having one end coupled to the locking unit;

a locking bracket selectively coupled to and released from the locking unit that moves by the movement of the locking lever; and an interlocking unit that is coupled to the other end of the bracket and interlocked with rotation of the locking unit, and simultaneously, interlocked with rotation of a push plate driving unit that drives the cassette push plate, wherein the locking unit further comprises a locking part engaged with the locking bracket, a locking pulley interlocked with the interlocking unit through a belt, and the torque limiter is disposed between the locking part and the locking pulley to couple the locking part to the locking pulley when the force less than the predetermined force is applied to the cassette push plate and decouple the locking part from the locking pulley when the force greater than the predetermined force is applied to the cassette push plate.

* * * * *